US009144352B2

(12) United States Patent
Cittadino et al.

(10) Patent No.: US 9,144,352 B2
(45) Date of Patent: Sep. 29, 2015

(54) CONTROLLED DISPENSING SHEET PRODUCT DISPENSER

(75) Inventors: Antonio M. Cittadino, Appleton, WI (US); James T. Olejniczak, Appleton, WI (US); Bret A. Kuehneman, Neenah, WI (US); Christopher M. Reinsel, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 692 days.

(21) Appl. No.: 11/866,515

(22) Filed: Oct. 3, 2007

(65) Prior Publication Data

US 2008/0078777 A1 Apr. 3, 2008

Related U.S. Application Data

(60) Provisional application No. 60/849,194, filed on Oct. 3, 2006, provisional application No. 60/849,209, filed on Oct. 3, 2006.

(51) Int. Cl.

| | |
|---|---|
| ***B65H 49/34*** | (2006.01) |
| ***A47K 10/34*** | (2006.01) |
| ***A47K 10/36*** | (2006.01) |
| ***B65H 16/00*** | (2006.01) |
| ***B65H 20/02*** | (2006.01) |

(52) U.S. Cl.

CPC ..... *A47K 10/34* (2013.01); *A47K 10/36* (2013.01); *B65H 16/005* (2013.01); *B65H 20/02* (2013.01)

(58) Field of Classification Search

USPC ..... 242/563, 563.2, 564, 564.1, 564.4, 390, 242/390.1, 390.2, 390.8, 390.9; 312/34.8, 312/34.22

See application file for complete search history.

(56) References Cited

U.S. PATENT DOCUMENTS

| | | | | |
|---|---|---|---|---|
| 2,121,346 | A | 6/1938 | Harvey | |
| 2,943,777 | A | 7/1960 | Dvoracek | |
| 2,993,658 | A | 7/1961 | Sweeney | |
| 4,165,138 | A | 8/1979 | Hedge et al. | |
| 4,552,315 | A | 11/1985 | Granger | |
| 4,765,555 | A * | 8/1988 | Gambino | 242/564.4 |
| 4,844,361 | A | 7/1989 | Granger | |
| 4,846,412 | A | 7/1989 | Morand | |
| 4,944,466 | A | 7/1990 | Jespersen | |
| D342,635 | S | 12/1993 | Carter et al. | |

(Continued)

FOREIGN PATENT DOCUMENTS

| | | |
|---|---|---|
| EP | 1230886 A1 | 8/2002 |
| FR | 2761252 A1 | 10/1998 |

(Continued)

OTHER PUBLICATIONS

International Preliminary Report on Patentability of PCT/US2007/080316, dated Apr. 16, 2009.

(Continued)

*Primary Examiner* — William A Rivera

(74) *Attorney, Agent, or Firm* — Sutherland Asbill & Brennan LLP

(57) ABSTRACT

A sheet product dispenser includes a sheet product feed mechanism coupled to an electric motor, the sheet product feed mechanism moving a sheet product out of the dispenser during a dispense cycle; and a control unit controlling the sheet product feed mechanism or electric motor or both to move the sheet product with an increasing speed or acceleration or both during a portion of the dispense cycle.

20 Claims, 10 Drawing Sheets

(56) References Cited

U.S. PATENT DOCUMENTS

| | | | | |
|---|---|---|---|---|
| 5,458,122 | A | 10/1995 | Hethuin | |
| 5,483,437 | A | 1/1996 | Tang | |
| 5,558,302 | A | 9/1996 | Jesperson | |
| 5,604,992 | A | 2/1997 | Robinson | |
| 5,628,474 | A | 5/1997 | Krueger et al. | |
| D386,025 | S | 11/1997 | Mervar et al. | |
| 5,772,291 | A | 6/1998 | Byrd et al. | |
| 5,773,938 | A * | 6/1998 | Seong et al. | 242/334.2 |
| 5,906,506 | A | 5/1999 | Chang et al. | |
| 5,979,821 | A | 11/1999 | LaCount et al. | |
| 5,979,822 | A | 11/1999 | Morand et al. | |
| 6,032,898 | A | 3/2000 | LaCount et al. | |
| 6,069,354 | A | 5/2000 | Alfano et al. | |
| 6,105,898 | A | 8/2000 | Byrd et al. | |
| 6,109,473 | A | 8/2000 | Neveu et al. | |
| 6,138,939 | A | 10/2000 | Phelps et al. | |
| 6,152,397 | A | 11/2000 | Purcell | |
| D441,231 | S | 5/2001 | Purcell et al. | |
| 6,237,871 | B1 | 5/2001 | Morand et al. | |
| 6,250,530 | B1 | 6/2001 | LaCount et al. | |
| 6,293,486 | B1 | 9/2001 | Byrd et al. | |
| 6,328,252 | B1 | 12/2001 | Neveu et al. | |
| 6,354,533 | B1 | 3/2002 | Jespersen | |
| 6,412,679 | B2 | 7/2002 | Formon et al. | |
| 6,474,591 | B1 | 11/2002 | Granger | |
| 6,592,067 | B2 | 7/2003 | Denen et al. | |
| 6,607,160 | B2 | 8/2003 | Lewis et al. | |
| 6,616,088 | B2 | 9/2003 | Lintelmann et al. | |
| 6,685,074 | B2 | 2/2004 | Gracyalny et al. | |
| 6,695,246 | B1 | 2/2004 | Elliott et al. | |
| 6,710,606 | B2 | 3/2004 | Morris | |
| 6,736,348 | B1 | 5/2004 | Formon et al. | |
| 6,742,689 | B2 | 6/2004 | Formon et al. | |
| 6,752,349 | B2 | 6/2004 | Moody et al. | |
| 6,793,170 | B2 | 9/2004 | Denen et al. | |
| 6,826,985 | B2 | 12/2004 | Broehl | |
| 6,830,210 | B2 * | 12/2004 | Formon et al. | 242/563 |
| 6,854,684 | B2 | 2/2005 | Byrd et al. | |
| 6,871,815 | B2 | 3/2005 | Moody et al. | |
| 6,895,848 | B1 | 5/2005 | Svennson | |
| 6,903,654 | B2 | 6/2005 | Hansen et al. | |
| 6,977,588 | B2 | 12/2005 | Schotz et al. | |
| 6,994,408 | B1 | 2/2006 | Bunnell | |
| 7,017,856 | B2 | 3/2006 | Moody et al. | |
| 7,040,566 | B1 | 5/2006 | Rodrian et al. | |
| 7,044,421 | B1 * | 5/2006 | Omdoll et al. | 242/564.4 |
| D525,063 | S | 7/2006 | Woods et al. | |
| 7,101,441 | B2 | 9/2006 | Kennard | |
| 7,161,359 | B2 | 1/2007 | Denen et al. | |
| 7,234,381 | B2 | 6/2007 | Granger | |
| D547,581 | S | 7/2007 | Cittadino et al. | |
| D551,474 | S | 9/2007 | Cittadino et al. | |
| D551,475 | S | 9/2007 | Cittadino et al. | |
| 7,296,765 | B2 * | 11/2007 | Rodrian | 242/563.2 |
| 7,370,824 | B1 * | 5/2008 | Osborne | 242/563 |
| D572,058 | S | 7/2008 | Cittadino et al. | |
| 7,398,944 | B2 | 7/2008 | Lewis et al. | |
| 7,438,257 | B2 * | 10/2008 | Kennard | 242/598.5 |
| 7,984,872 | B2 | 7/2011 | Kuehneman et al. | |
| 2002/0109035 | A1 | 8/2002 | Denen et al. | |
| 2003/0132261 | A1 | 7/2003 | Formon et al. | |
| 2003/0167893 | A1 | 9/2003 | Morris et al. | |
| 2003/0168489 | A1 | 9/2003 | Formon et al. | |
| 2003/0168550 | A1 | 9/2003 | Formon et al. | |
| 2003/0197086 | A1 | 10/2003 | Denen et al. | |
| 2004/0035976 | A1 | 2/2004 | Byrd et al. | |
| 2004/0041057 | A1 | 3/2004 | Byrd et al. | |
| 2004/0135027 | A1 | 7/2004 | Elliott et al. | |
| 2004/0178297 | A1 | 9/2004 | Moody et al. | |
| 2005/0077419 | A1 | 4/2005 | Thomas et al. | |
| 2005/0150992 | A1 | 7/2005 | Morris et al. | |
| 2006/0054733 | A1 | 3/2006 | Moody et al. | |
| 2006/0169827 | A1 * | 8/2006 | Lewis et al. | 242/563 |
| 2006/0175341 | A1 * | 8/2006 | Rodrian | 221/13 |
| 2006/0202080 | A1 * | 9/2006 | Kennard | 242/598.3 |
| 2007/0080255 | A1 | 4/2007 | Witt et al. | |
| 2007/0176041 | A1 | 8/2007 | Friesen et al. | |
| 2008/0018302 | A1 * | 1/2008 | Reinsel et al. | 242/564.1 |
| 2008/0128446 | A1 | 6/2008 | Kuehneman et al. | |
| 2009/0056286 | A1 * | 3/2009 | Bertram et al. | 53/505 |

FOREIGN PATENT DOCUMENTS

| | | | |
|---|---|---|---|
| GB | 2063213 A | | 6/1981 |
| JP | 4-265699 | * | 9/1992 |

OTHER PUBLICATIONS

International Search Report and Written Opinion of the International Searching Authority that issued Jun. 3, 2008 in connection with PCT/US2007/080316.

Information on Product Code: 09619, Kimberly Clark Professional wbsite, http://www.kcprofessional.com/us/product-details.asp-?prd_id=09619, viewed Dec. 17, 2007 (copy of page submitted with this IDS).

Office Action for U.S. Appl. No. 11/866,510 mailed Sep. 29, 2009.

Office Action for U.S. Appl. No. 11/866,510 mailed Mar. 31, 2010.

Search Report and Written Opinion of the International Searching Authority for PCT/US2007/080311 mailed Jun. 4, 2008.

Office Action for U.S Appl. No. 11/866,510 Mailed Oct. 14, 2010.

Office Action for European Serial No. 07 853 747.9 issued by the European Patent Office on Dec. 27, 2011.

Office Action for European Serial No. 7 853 747.9 Issued by the European Patent Office on Mar. 3, 2010.

Translation of Office Action for Chinese Serial No. 200780037029.5 Issued by the State Intellectual Property Office of the People's Republic of China on Jun. 11, 2010.

Translation of Decision to Grant for Russian Serial No. 2009116633 Issued by the Patent Office of the Russian Federation on Feb. 9, 2011.

* cited by examiner

CONTROLLED DISPENSING SHEET PRODUCT DISPENSER

CROSS-REFERENCE TO RELATED APPLICATIONS

This application claims the benefit of the filing date of U.S. Provisional Patent Application No. 60/849,194, filed Oct. 3, 2006, and U.S. Provisional Patent Application No. 60/849,209, Oct. 3, 2006, which are herein incorporated by reference in their entirety.

BACKGROUND

The present disclosure generally relates to sheet product dispensers, and more particularly, to sheet product dispensers having controlled dispensing mechanisms.

Electronic paper product dispensers are well known in the art, including dispensers that automatically dispense a metered length of paper material upon sensing the presence of a user. This type of dispenser has become known in the art as a "hands-free" dispenser in that it is not necessary for the user to manually actuate or otherwise handle the dispenser to initiate a dispense cycle. The control systems and mechanical aspects of conventional hands-free dispensers are wide and varied. Electric drive motors are often used to power dispensing mechanisms. Known control systems provide abrupt activation and deactivation of these drive motors during a dispense cycle. Such abrupt changes in motor speed or acceleration result in impulses, which are transferred to system components and the paper product during the dispense cycle. Paper jamming and excessive parts wear may result.

Accordingly, a continual need exists for improved controlled dispensing sheet product dispensers.

BRIEF SUMMARY

Disclosed herein are sheet product dispensers and methods of dispensing sheet products.

In one embodiment, a sheet product dispenser comprises a sheet product feed mechanism coupled to an electric motor, the sheet product feed mechanism moving a sheet product out of the dispenser during a dispense cycle; and a control unit controlling the sheet product feed mechanism or electric motor or both to move the sheet product with an increasing speed or acceleration or both during a portion of the dispense cycle.

In one embodiment, a method of dispensing a sheet product comprises activating a variable speed dispensing mechanism in response to a user activation, the dispensing mechanism gradually increasing a speed of a dispensed sheet product during a dispense cycle.

In one embodiment, a sheet product dispenser comprises an electric motor driving a dispensing mechanism to move a sheet product; a battery having a voltage which decreases over time; and an electronic controller for controlling a connection between the electric motor and the battery, the controller determining a run time for the electric motor, the run time being dependent on the voltage, wherein as the voltage decreases over time, the run time increases.

In one embodiment, a dispenser for sheet products comprises an electric motor driving a dispensing mechanism to move a sheet product; and an electronic controller for operatively coupling the electric motor to a battery, wherein the electric motor is driven for variable time periods based on a battery voltage, the dispenser moving a generally equal length of sheet product out of the dispenser by increasing a motor run time as the battery voltage decreases over time.

In one embodiment, a sheet product dispenser comprises an electric motor driving a dispensing mechanism to move a sheet product; a battery having a voltage which decreases over time; and a motor control which determines a run time for the electric motor, the run time being corrected for a decrease in battery voltage.

The above described and other features are exemplified by the following Figures and detailed description.

BRIEF DESCRIPTION OF THE DRAWINGS

Referring to the exemplary drawings wherein like elements are numbered alike in the several Figures.

DETAILED DESCRIPTION

Disclosed herein are controlled dispensing sheet product dispensers. The control mechanisms disclosed herein can advantageously be adopted for use with a variety of sheet product dispensers. For example, the sheet product dispenser may be employed with one or more rolls. The term "sheet products" is inclusive of natural and/or synthetic cloth or paper sheets. Further, sheet products can include both woven and non-woven articles. Examples of sheet products include, but are not limited to, wipers, napkins, tissues, and towels.

Figure 1:
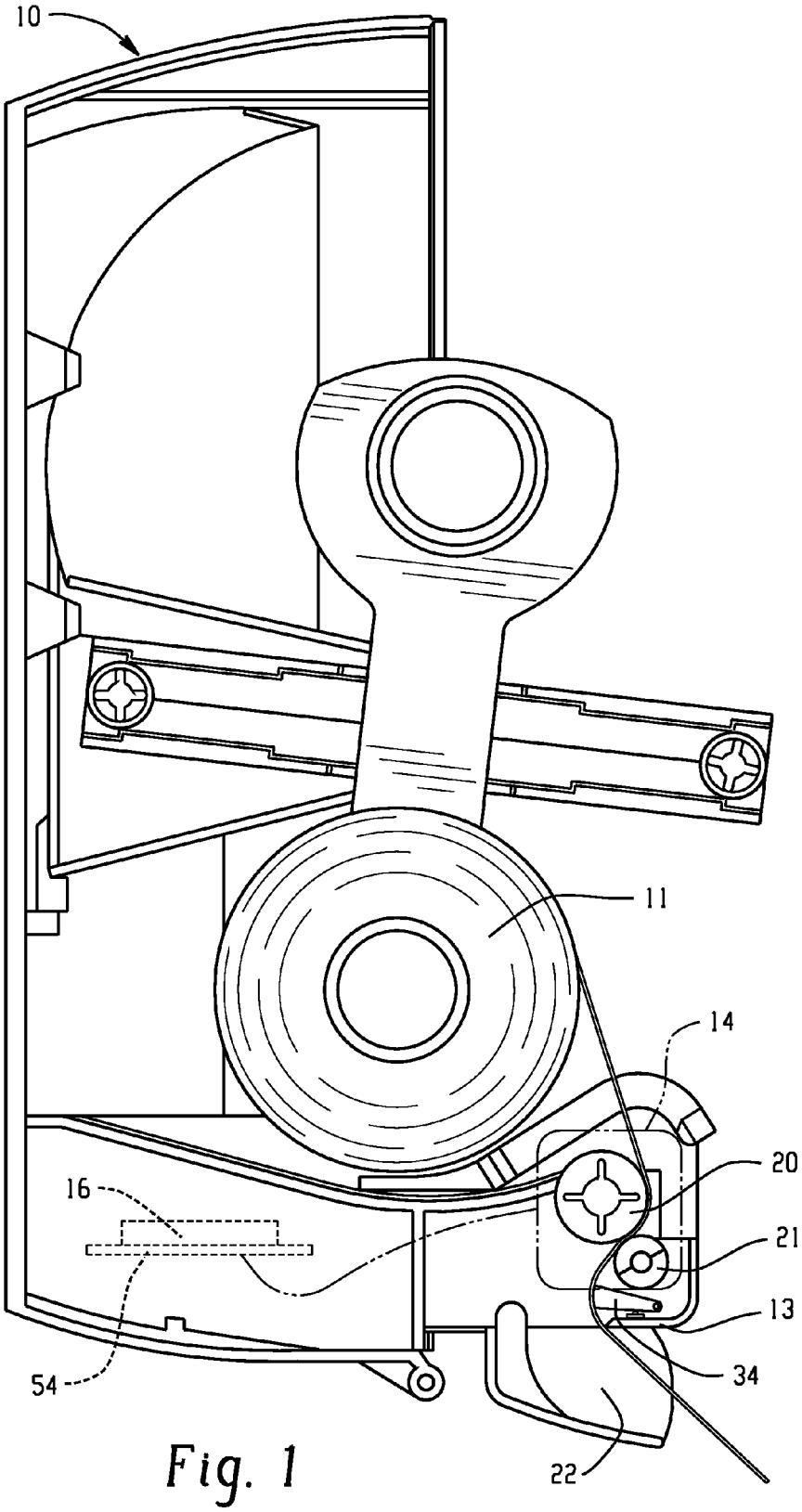
FIG. 1 illustrates a portion of an exemplary sheet product dispenser.

Referring now to FIG. 1, a portion of a sheet product dispenser, generally designated 10, is provided to schematically illustrate various mechanical components employed in exemplary automatic sheet product dispensers with the understanding that the mechanical components disclosed herein are not limiting to the invention. Exemplary mechanical aspects of dispensers include, but are not limited to, those mechanical aspects disclosed in U.S. Pat. Nos. 6,592,067; 6,793,170; 6,838,887; 6,871,815; 7,017,856; 7,102,366; 7,161,359; 7,182,288; 7,182,289; and U.S. Patent Publication No. 2007/0194166, each patent and patent application being incorporated herein by reference in its entirety.

In one embodiment, the sheet product dispenser 10 includes a sheet product supply, such as a roll 11 of sheet product (e.g., tissue paper) and a feed mechanism for moving sheet product within and out of dispenser 10. Feed mechanism may include a feed roller 20, pinch roller 21 and sheet product chute 22. Dispenser 10 may be adapted for hands-free operation for dispensing one or more rolls 11 of sheet product. Dispenser 10 may further include an optional tear bar assembly 13 allowing a sheet of the sheet product to be separated from sheet product roll 11.

Figure 2:
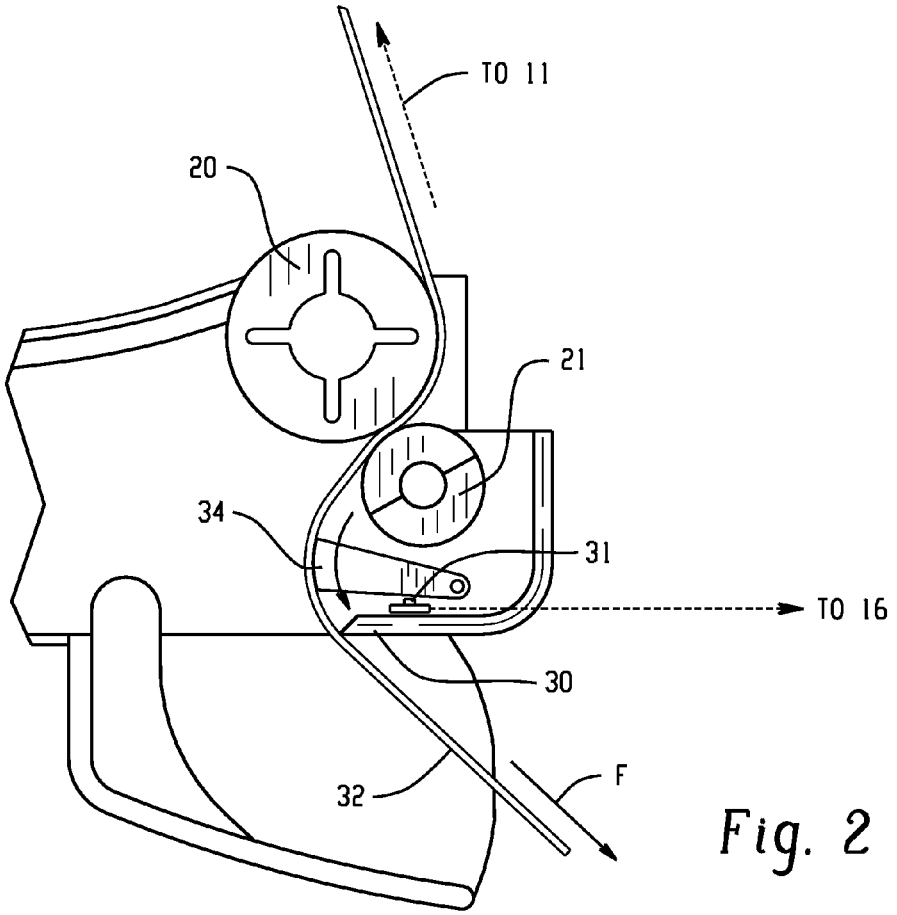
FIG. 2 is an illustration of a portion of the dispenser of FIG. 1.

As shown in FIGS. 1-2, optional tear bar assembly 13 includes a tear bar 30 and tear bar switch 31 in communication with a microprocessor (also referred to interchangeably as controller 16) as described in more detail hereinafter. In operation, to remove a portion 32 of sheet product roll 11, a user pulls portion 32 downward against stationary tear bar 30. As sheet portion 32 is pulled against tear bar 30, contact is made between the sheet and movable arm 34 causing arm 34 to rotate into contact with tear bar switch 31. Upon engagement with arm 34, tear bar switch 31 signals controller 16 that a tear operation has taken place.

Referring again to FIG. 1, the feed mechanism may be run by a motor 14 (shown in phantom). The type of motor varies depending on the application. For example, suitable motors include brushed motors and brushless motors (e.g., a stepper motor). Motor 14 is powered by power supply (not shown), such as a battery pack or external AC (e.g., with an appropriate transformer and adapter) or DC power supply. Moreover, it is to be understood that the dispenser 10 may be configured to be switched between battery power and AC power. In one embodiment, the motor 14 can be a variable speed DC motor controlled by controller 16.

In one embodiment, the controller 16 is a non-feedback-based controller operating without direct measurement of the dispensed length of sheet product. More particularly, it has been discovered that the dispensed length of sheet product can be approximated in relation to the speed of the motor, that is the speed of the motor is proportional to the sheet product dispense speed. Once the motor 14 is selected for the dispenser 10, the time to dispense a given length of sheet product can be determined. In other words, the controller 16 can be programmed to run for a predetermined time based upon the speed of the motor. It is to further be understood that the controller 16 can be set to different sheet length settings (e.g., 4 inches, 6 inches, etc.).

In one embodiment, the controller 16 decreases the motor 14 and sheet product dispense acceleration and/or speed during a terminal portion of the dispense cycle. During an intermediate portion of the dispense cycle, the feed mechanism dispenses the sheet product at an intermediate speed, which may be generally constant. The dispenser 10 may move the sheet product at a controlled acceleration during an initial portion of the dispense cycle. The acceleration may be changed based on a sheet product characteristic. Acceleration rates may be related to sheet product strength. For example, a tissue paper may be moved with a lower acceleration as compared to a paper towel.

When the dispenser 10 is battery powered, battery voltage decreases over time. A lower voltage applied to the drive motor results in a slower motor speed. In one embodiment, the controller 16 can be programmed to increase the length of the dispense cycle to correct for decreases in battery voltage. As a result of this correction, a relatively consistent dispensed length of sheet product is provided throughout the battery life. The battery voltage may be measured during the dispense cycle. In comparison, typical dispensing mechanisms measure the dispensed sheet length by various means, such as a timing circuit that stops the drive roller after a predetermined time or a revolution counter that measures the rotation of the drive roller, for example, with an optical encoder or mechanical counter. Limitations of such feedback-based control systems include various mechanical and electrical failures.

Figure 3:
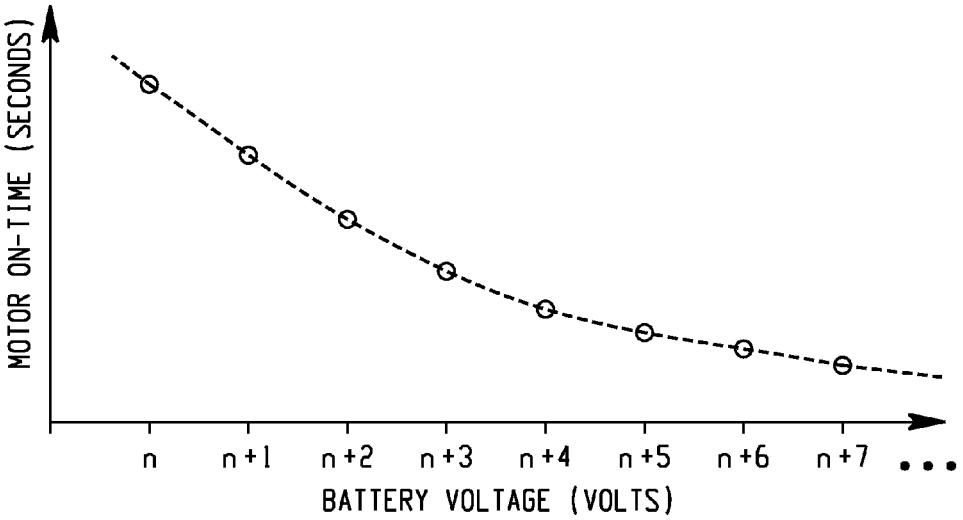
FIG. 3 is an illustration of a relationship between motor run-time and battery voltage.

FIG. 3, with periodic reference to FIG. 1, illustrates the concept of relating motor 14 run-time to measured battery voltage. FIG. 3 illustrates that motor 14 run-time increases as the battery voltage decreases. In one embodiment, controller 16 uses battery voltage information and not sheet product dispense speed or length to control motor 14 on-time, and hence dispensed sheet product length. More particularly, in one embodiment, the controller 16 is in communication with a battery voltage sensor. As a result, all circuitry can be incorporated on a single circuit board with a reasonable number of connectors.

The rotational speed and/or acceleration of motor 14 is controlled by controller 16. Motor 14 may be a variable speed DC motor and controller 16 may provide pulse-width-modulation (PWM) speed control of motor 14. As the speed of motor 14 is varied by controller 16, the speed of sheet product moved within and dispensed from dispenser 10 is also varied. In one embodiment, with motor 14 directly connected to the drive roller of the dispensing mechanism, a direct relationship is exhibited between motor 14 speed and sheet product dispense speed.

Figure 4:
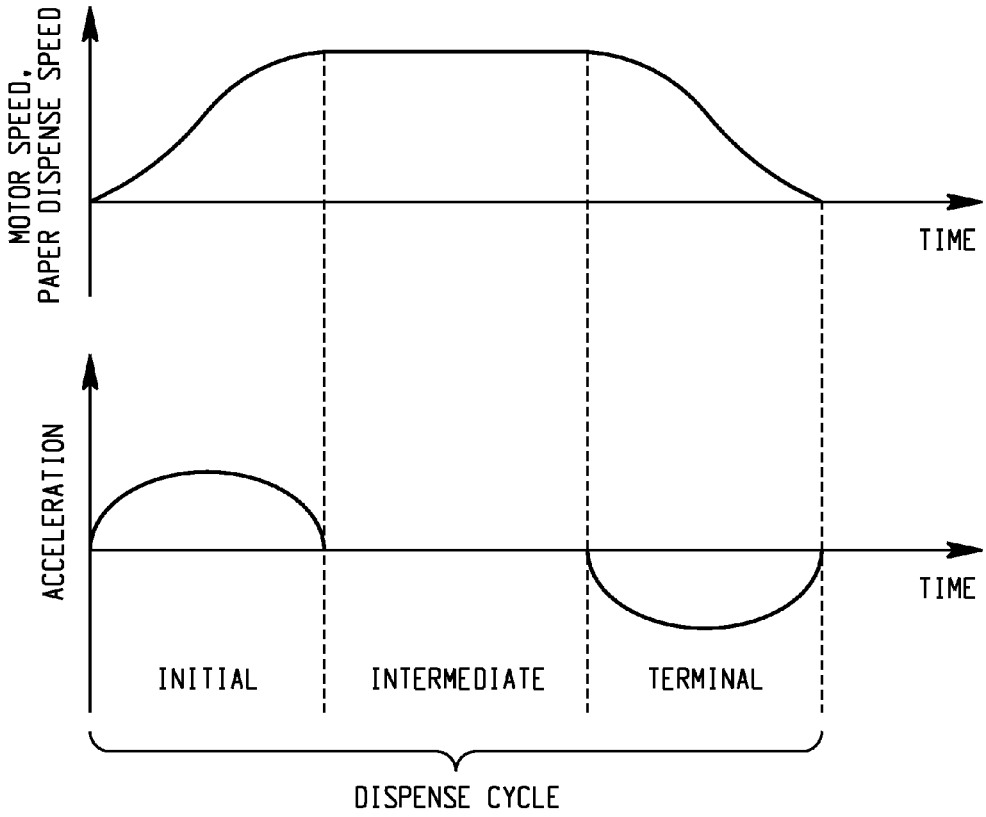
FIG. 4 is an illustration of speed and acceleration curves for motor speed or sheet product dispense speed for an exemplary sheet product dispenser.

FIG. 4, with periodic reference to FIG. 1, illustrates relationships between sheet product dispense speed, acceleration and time over a dispense cycle of the dispenser 10. As the speed of motor 14 is proportional to the sheet product dispense speed, FIG. 4 also illustrates velocity and acceleration curves exhibited by motor 14 during the dispense cycle. A dispense cycle is initiated by ON switch activation (i.e., a user dispense request). The ON switch signal may be provided, for example, by a push button switch, an I/R (infrared) proximity sensor, a capacitance-based proximity sensor or another electronic proximity sensor. In response to ON switch activation, a length of sheet product is dispensed during a dispense cycle.

FIG. 4 shows possible curves for both the speed and acceleration of motor 14 speed during initial, intermediate and terminal portions of the dispense cycle. During the initial portion of the dispense cycle, motor 14 speed increases to a maximum motor speed. During an intermediate portion of the dispense cycle, motor 14 speed is generally constant. The length of the intermediate portion may be fixed or variable as determined by controller 16. During a terminal portion of the dispense cycle, motor 14 speed gradually decreases to zero. In one embodiment, the dispense cycle has a length of between 5 to 10 seconds for a non-continuous mode of operation.

By controlling the acceleration and deceleration of the sheet product as it is dispensed, product damage and jamming can be minimized. This is especially significant with light weight tissue paper products. Controlled acceleration of the sheet product may also decrease the impulse loads applied through the transmission and dispensing mechanism.

While FIG. 4 illustrates particular curves of velocity and acceleration during a dispense cycle, curves of velocity and acceleration during a dispense cycle may vary. For example, motor velocity may increase linearly during the initial portion of the dispense cycle or the length of the intermediate portion may be shortened or lengthened depending on a particular application or product and depending on the voltage measured during the cycle or preceding cycles. It is envisioned that a variety of different curves could be utilized to practice the concept of controlled velocity and/or acceleration of the product during a dispense cycle. In other embodiments, the dispenser 10 may use a switching power supply to obviate the need for voltage measurement. In other words, the switching power supply provides a constant voltage output. Other motor control technologies may be used to control the speed of motor 14.

Figure 5:
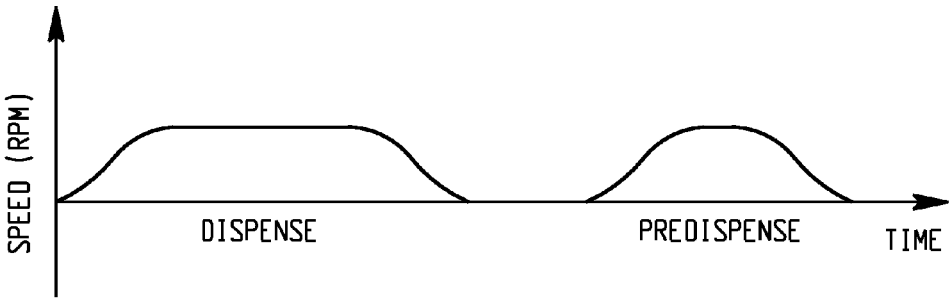
FIG. 5 is an illustration of a speed curve for motor speed or sheet product dispense speed for another dispenser embodiment.

FIG. 5 illustrates another velocity curve during a dispense cycle and a subsequent pre-dispense cycle. During a pre-dispense cycle, a short length of the sheet product is dispensed. The length of the sheet product could be determined by characteristics of the pre-dispense cycle as defined by controller 16 (FIG. 1).

In one embodiment, referring again to FIGS. 1-2, the control system of dispenser 10 includes electronic controller 16 having a plurality of inputs and outputs. Inputs to controller 16 can include, but are not limited to, a battery voltage signal, a tear bar activation signal, a continuous mode switch signal, a door switch signal, a sheet product length switch signal, an advance switch signal and an on switch signal. Outputs of controller 16 can include, but are not limited to, a motor control signal and LED signals for ACTIVE, ROLLOUT and LOW BATTERY. Motor control signal is used to control the speed of motor 14 and hence the speed of sheet product moved by feed mechanism as described herein. The battery voltage signal is provided by a voltage sensor in communication with the battery pack of power supply. The voltage signal used can be measured during the cycle whose length is being determined. In some embodiments, measurement from a preceding cycle or cycles may be stored and used as discussed in U.S. Pat. Nos. 6,903,654 and 6,977,588, which are incorporated by reference in their entirety. The tear bar activation signal is provided by tear bar switch 31. The door switch is provided, for example, by a limit switch in selective contact with the housing door. The sheet product length switch signal is provided, for example, by a three way switch with positions corresponding to different sheet product lengths.

Figure 6:
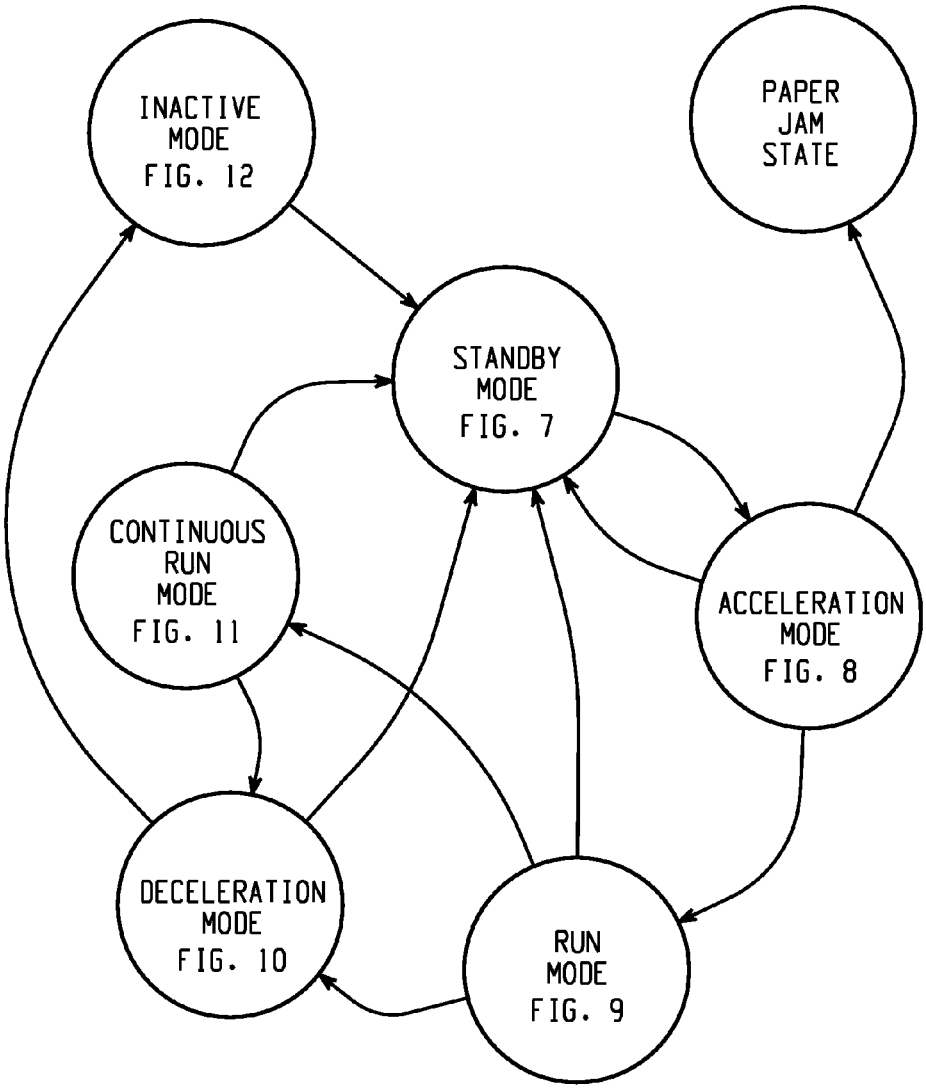
FIG. 6 is an illustration of a state diagram for a control system used in an exemplary sheet product dispenser.

Referring now to FIG. 6, an embodiment of a state diagram for dispenser controller 16 is illustrated. The state diagram depicts mutually exclusive operational states of controller 16 and dispenser 10 conditions. Movement between states occurs when one or more of the underlying conditions change. During a dispense cycle, such as shown in FIG. 4, controller 16 operates between at least some of the operational states of FIG. 6.

Figure 7:
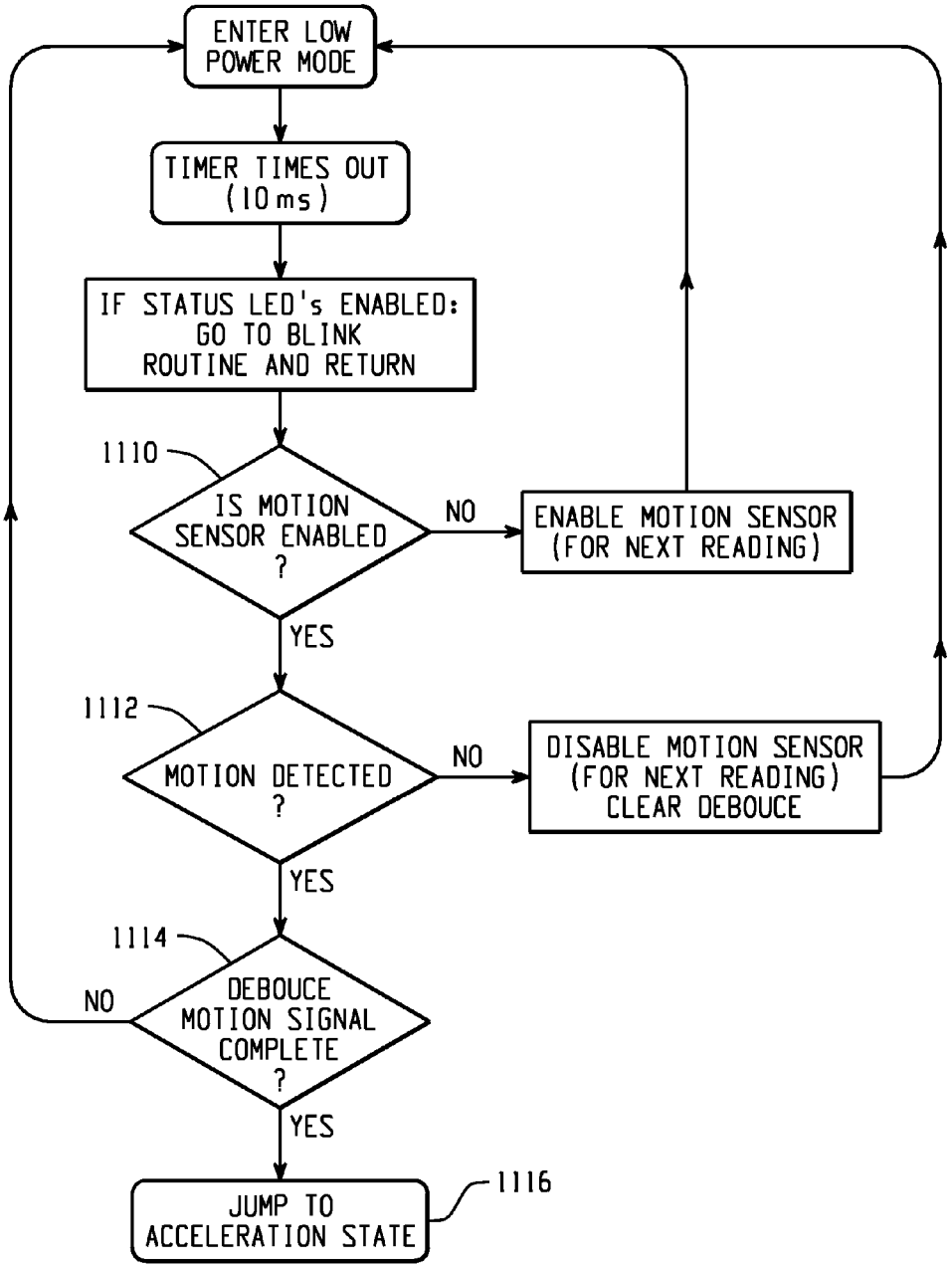
FIG. 7 is a flow diagram of a control system operations within a STANDBY mode of operation.

During the STANDBY state, controller periodically determines whether a dispense operation should be entered. In the STANDBY state, motor remains unactivated. FIG. 7 illustrates an embodiment of a flowchart depicting functions of controller while in STANDBY state. For example, controller determines at steps 1110, 1112, 1114 whether a use is requested by operation of a proximity sensor or motion sensor. Upon determination of a use request at step 1114, controller transitions to the ACCELERATION state at step 1116.

Figure 8:
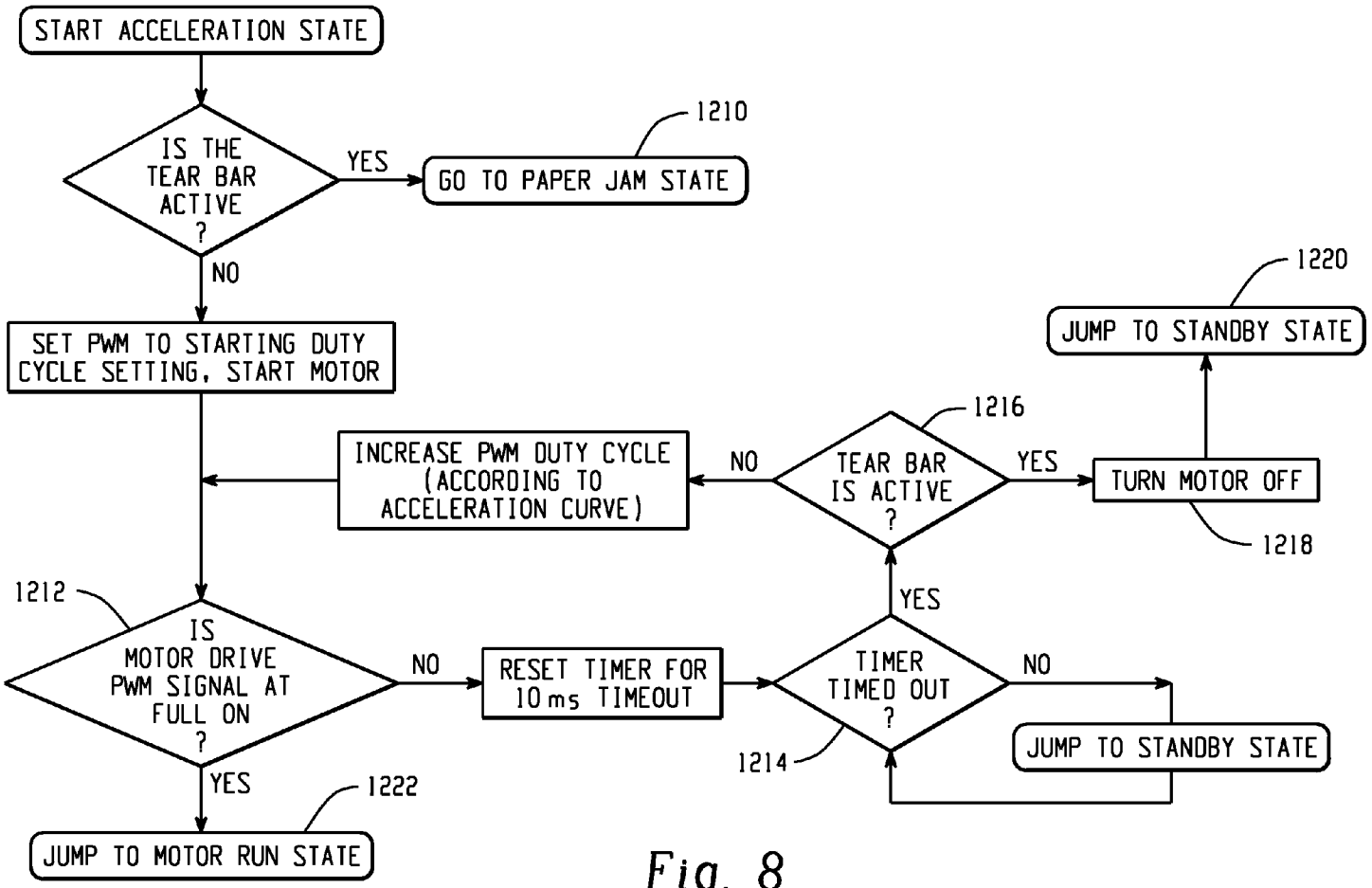
FIG. 8 is a flow diagram of a control system operations within a ACCELERATION mode of operation.

FIG. 8 illustrates an embodiment of a flowchart depicting functions of controller while in ACCELERATION state. During the ACCELERATION state, controller activates motor and the speed of motor is increased until it reaches a maximum speed. The ACCELERATION state corresponds to operation within the initial portion of the dispense cycle of FIG. 4. If the optional tear bar switch is activated upon entering the ACCELERATION state, controller transitions to a JAM state at step 1210. Otherwise, controller gradually increases the dispensed sheet product speed via pulse width modulation of motor as indicated by steps 1212 and 1214. If optional tear bar switch is activated during this period, the controller turns motor off and transitions back to the STANDBY state at steps 1216, 1218, 1220. Once motor drive signal has reached a maximum level, controller transitions to MOTORRUN state at step 1222. The maximum level of the drive signal may be variable. In one example, the motor drive signal is a PWM signal ranging from approximately 20% to 100% duty cycle.

Figure 9:
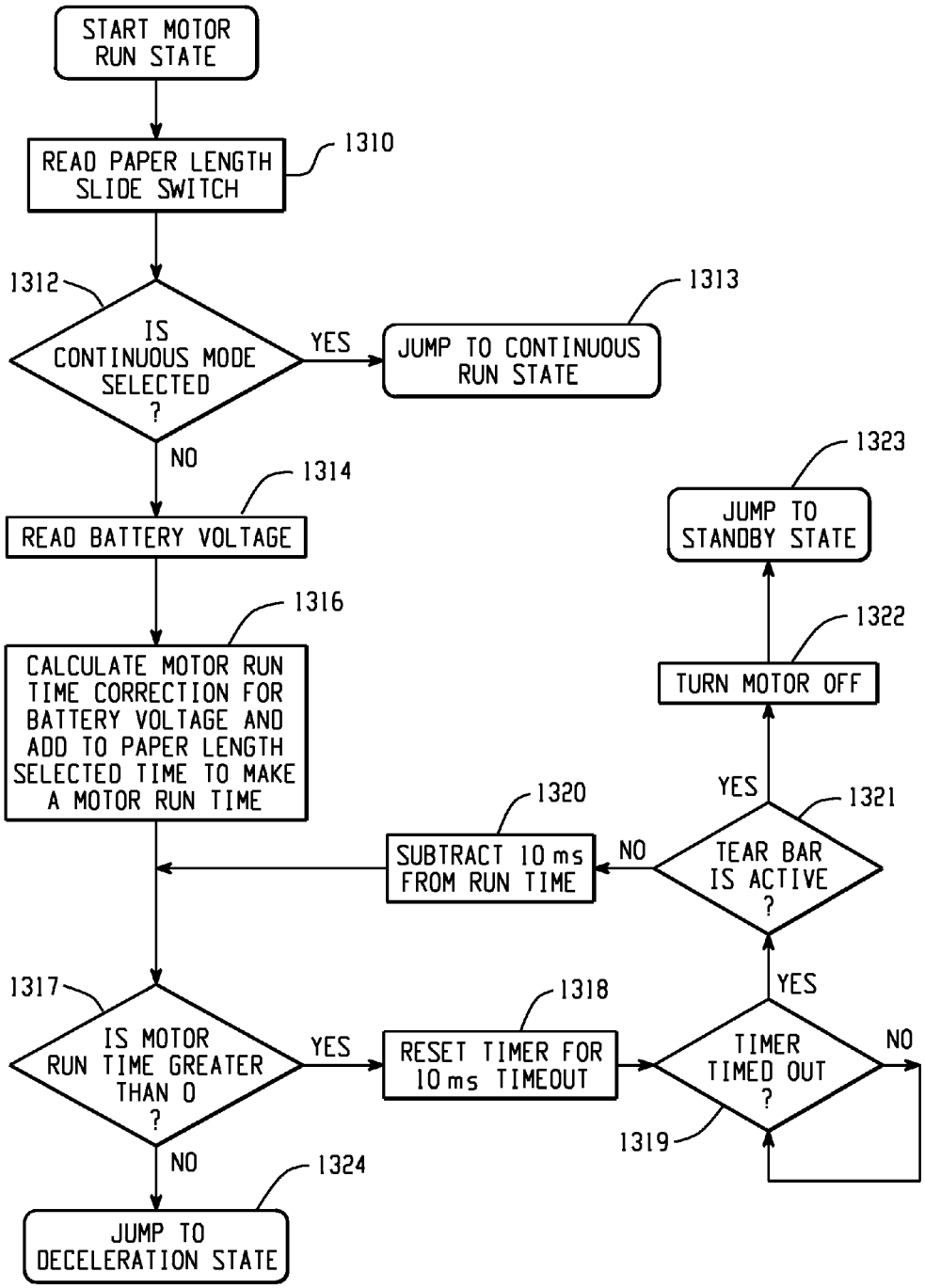
FIG. 9 is a flow diagram of a control system operations within a MOTORRUN mode of operation.

FIG. 9 illustrates an embodiment of a flowchart depicting functions of controller while in a MOTORRUN state. The MOTORRUN state corresponds to operation within the intermediate portion of the dispense cycle of FIG. 4. Referring to FIG. 9, a sheet product length switch is read at step 1310 and a determination of CONTINUOUS mode selection is made at step 1312. If CONTINUOUS mode is selected, controller transitions to the CONTINUOUS RUN state at step 1313. If not, controller reads battery voltage at step 1314 and calculates a motor run time with correction for a reduction in battery voltage at step 1316. Motor is then run for the calculated run time at steps 1318, 1319, 1320. While in motor running, detection of tear bar switch activation at step 1321 causes motor to turn off at step 1322 and controller transitions to STANDBY state at step 1323. Upon completion of the run time, controller transitions to the DEACCELERATION state at step 1324.

Figure 10:
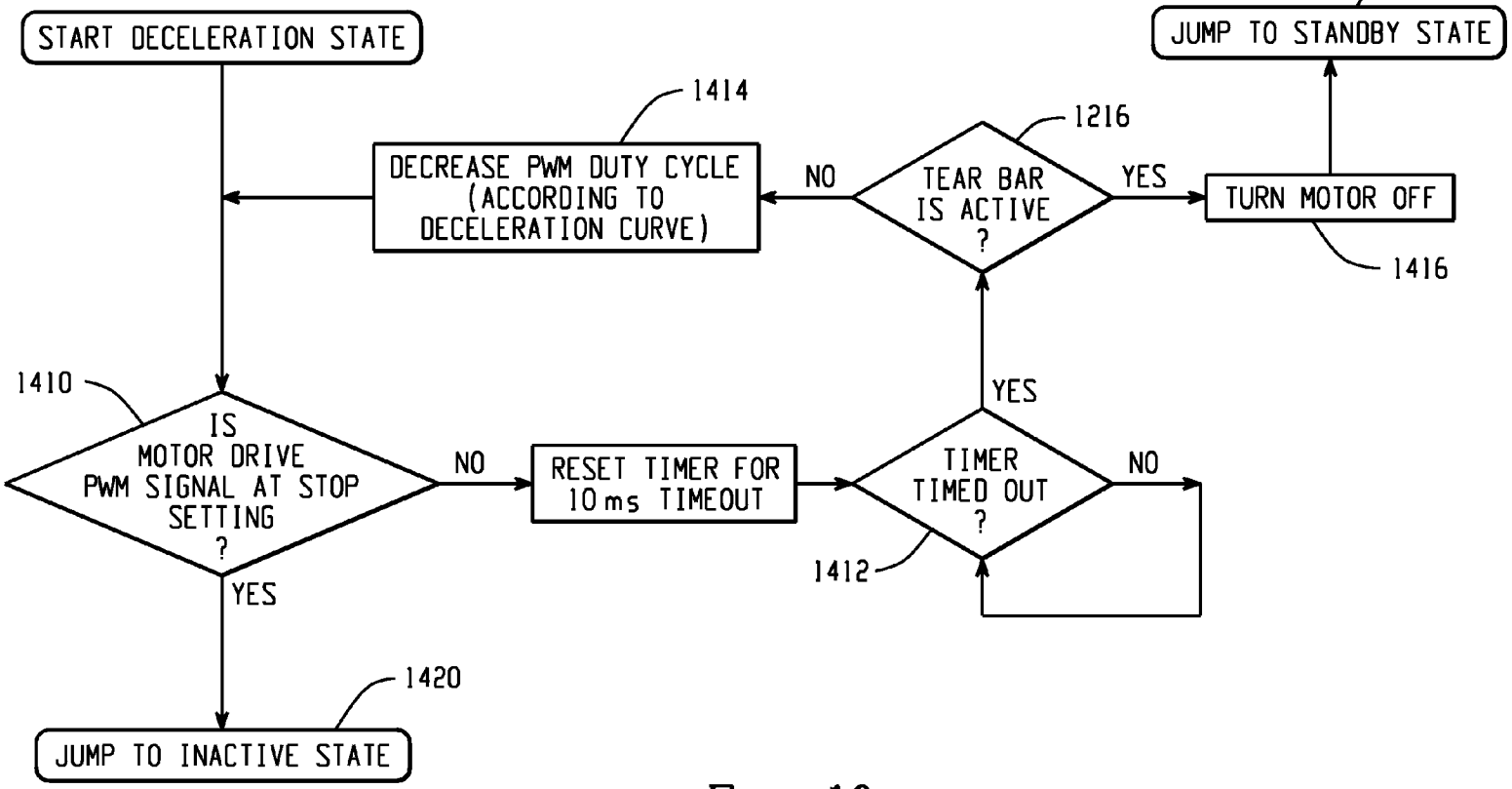
FIG. 10 is a flow diagram of a control system operations within a DEACCELERATION mode of operation.

FIG. 10 illustrates an embodiment of a flow chart depicting functions of controller while in the DEACCELERATION state. This state corresponds to the terminal portion of the dispense cycle of FIG. 4. Referring to FIG. 10, the controller gradually decreases motor speed by decreasing the PWM duty cycle applied to motor at steps 1410, 1412, 1414. Activation of tear bar switch during this period causes motor to turn off at step 1416 and controller to transition to STANDBY state at step 1418. Once motor speed has decreased to a minimum level and stopped, the controller transitions to the INACTIVE state at step 1420.

Figure 11:
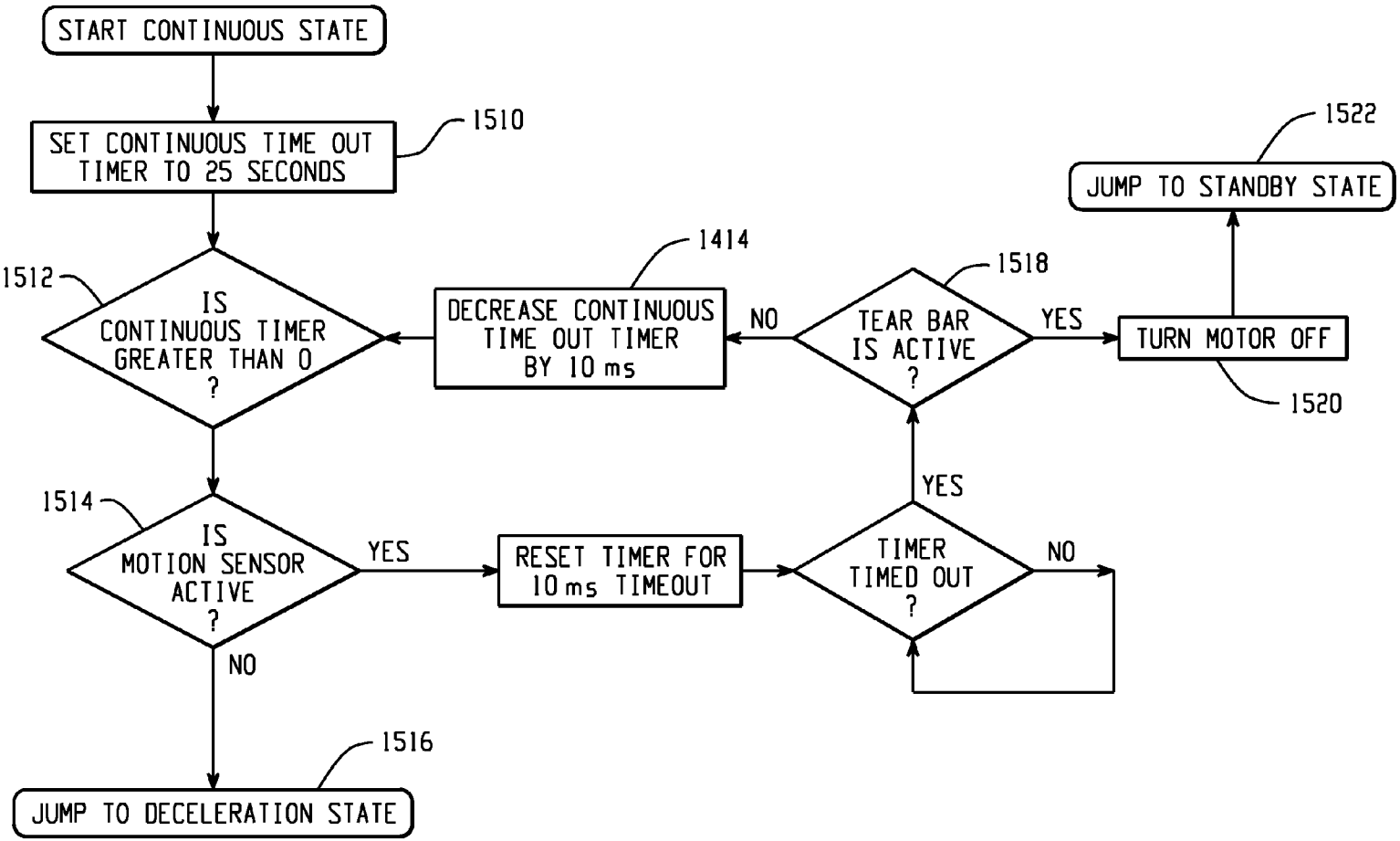
FIG. 11 is a flow diagram of a control system operations within a CONTINUOUS mode of operation.

FIG. 11 illustrates an embodiment of a flow chart depicting functions of controller while in the CONTINUOUS state. In this mode of operation, controller provides a continuous sheet product flow as long as the ON switch is activated. A CONTINUOUS time out timer is set at step 1510. An inquiry whether the time remains is made at step 1512. If the ON switch (motion sensor) is not active at step 1514, controller transitions to the DEACCELERATION state at step 1516. Activation of tear bar switch at step 1518 causes controller to turn motor off and transition to the STANDBY state at step 1520.

Figure 12:
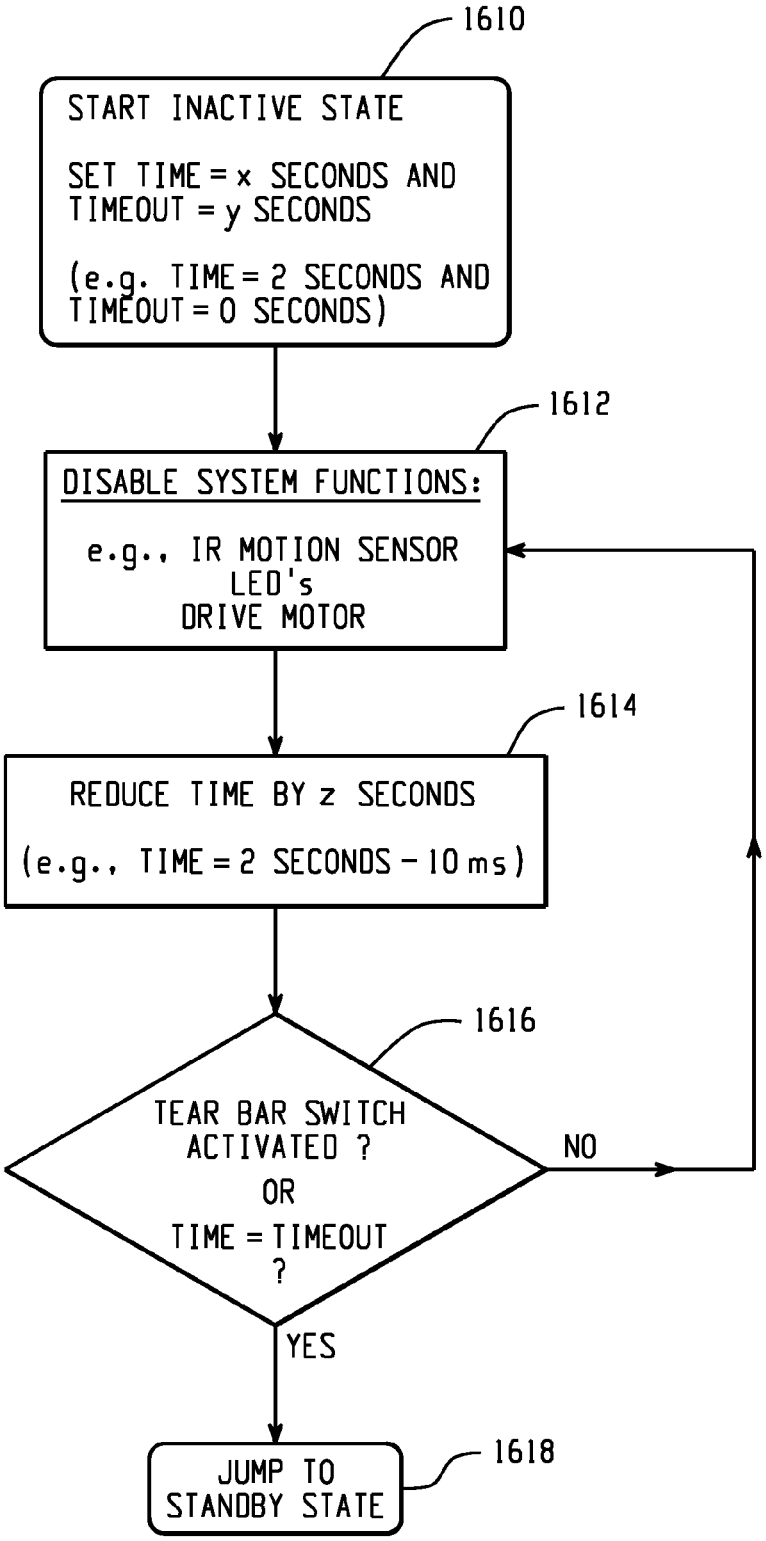
FIG. 12 is a flow diagram of a control system operation within an INACTIVE mode of operation.

FIG. 12 illustrates an embodiment of a flow chart depicting functions of controller while in the INACTIVE state. Referring to FIG. 12, a timer value, TIME, and a time out value, TIMEOUT, are defined for the INACTIVE state at step 1610. For example, TIME=2 seconds, and TIMEOUT=0 seconds. Motor, dispenser LEDs, and ON switch/IR motion sensor are all then disabled as shown at step 1612. The timer value, TIME, is reduced at step 1614. Inquiries of tear bar switch activation and/or TIME=TIMEOUT are made at step 1616. If tear bar switch has been activated or TIME=TIMEOUT, then controller transitions to the STANDBY state at step 1618. Otherwise, the controller returns to step 1612.

In one embodiment, a method of dispensing sheet product includes activating a variable speed dispensing mechanism to move the sheet product at a first acceleration rate during an initial period, and activating the dispensing mechanism to move the sheet product at a second speed or acceleration rate during an intermediate period. The second speed may be generally constant. The method may also include activating the dispensing mechanism to move the sheet product at a decreasing speed or acceleration rate during a terminal portion of the dispense cycle. The dispensing mechanism includes an electronic motor powering a feed roller to move the sheet product.

Advantageously, in comparison to the abrupt activation and deactivation of prior art drive motors, embodiments disclosed herein provide for gradual increase and decrease of drive motor and/or sheet product acceleration during a dispense cycle. As a result, forces applied to the sheet product during a dispense cycle can be decreased by this controlled application of drive motor speed. Benefits include, but are not limited to, reduction in the number and size of parts within a dispense mechanism, less frequent jamming, and improved product reliability.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A sheet product dispenser comprising:

a sheet product feed mechanism coupled to an electric motor, the sheet product feed mechanism operative to move a sheet product out of the dispenser during a dispense cycle; and a control unit communicatively connected to the electric motor, the control unit operative to control a deceleration state of the dispense cycle by sending a control signal to the electric motor that gradually decreases a sheet product dispense speed of the sheet product feed mechanism over a period of time.

2. The dispenser of claim 1, wherein the control signal to the electric motor that gradually decreases the sheet product dispense speed of the sheet product feed mechanism comprises a pulse width modulation signal with a decreasing duty cycle.

3. The dispenser of claim 1, wherein the control unit is further operative to control a constant velocity state of the dispense cycle by sending a control signal to the electric motor that maintains a generally constant sheet product dispense speed of the sheet product feed mechanism.

4. The dispenser of claim 1, wherein the control unit is operative to control the deceleration state of the dispense cycle by:

determining whether the control unit is outputting a motor drive signal at a stop setting; and sending the control signal to the electric motor that gradually decreases the sheet product dispense speed of the sheet product feed mechanism responsive to determining that the control unit is not outputting the motor drive signal at the stop setting.

5. The dispenser of claim 1, wherein the control unit is operative to control the deceleration state of the dispense cycle by:

determining whether the control unit is outputting a motor drive signal at a stop setting;

starting a timer responsive to determining that the control unit is not outputting the motor drive signal at the stop setting;

determining whether a time-count value of the timer has expired; and sending the control signal to the electric motor that gradually decreases the sheet product dispense speed of the sheet product feed mechanism responsive to determining that the timer has expired.

6. The dispenser of claim 1, wherein the dispenser is battery powered, and wherein the control unit is operative to determine a motor run-time of the dispense cycle with correction for a decrease in battery voltage.

7. The dispenser of claim 1, wherein the dispenser is battery powered, and wherein the control unit is operative to increase a duration of the dispense cycle as battery voltage decreases.

8. The dispenser of claim 1, wherein the dispenser is operable in a CONTINUOUS mode such that a duration of the dispense cycle is not predetermined.

9. The dispenser of claim 1, wherein a rate of deceleration of the sheet product feed mechanism is based on a characteristic of the sheet product.

10. The dispenser of claim 9, wherein the rate of deceleration of the sheet product feed mechanism is based on a strength of the sheet product.

11. The dispenser of claim 1, wherein the control signal to the electric motor gradually decreases the sheet product dispense speed of the sheet product feed mechanism at a varying rate of deceleration.

12. The dispenser of claim 11, wherein the control signal to the electric motor gradually decreases the sheet product dispense speed of the sheet product feed mechanism at an increasing rate of deceleration and then a decreasing rate of deceleration.

13. A method for controlling a sheet product dispenser, the method comprising:

initiating a sheet product dispense cycle that includes a substantially constant velocity state and a deceleration state; and following the substantially constant velocity state, controlling the deceleration state of the sheet product dispense cycle by sending a control signal to an electric motor that gradually decreases a sheet product dispense speed of a sheet product feed mechanism over a period of time.

14. The method of claim 13, wherein controlling the deceleration state of the sheet product dispense cycle comprises:

determining whether the control unit is outputting a motor drive signal at a stop setting prior to sending the control signal to the electric motor that gradually decreases the sheet product dispense speed of the sheet product feed mechanism, and sending the control signal to the electric motor that gradually decreases the sheet product dispense speed of the sheet product feed mechanism responsive to determining that the control unit is not outputting the motor drive signal at the stop setting.

15. The method of claim 13, wherein the control signal to the electric motor that gradually decreases the sheet product dispense speed of the sheet product feed mechanism comprises a pulse width modulation signal with a decreasing duty cycle.

16. A sheet product dispenser comprising:

a sheet product feed mechanism coupled to an electric motor, the sheet product feed mechanism operative to move a sheet product out of the dispenser during a dispense cycle; and a control unit communicatively connected to the electric motor, the control unit operative to control a deceleration state of the dispense cycle by sending a control signal to the electric motor that decreases a sheet product dispense speed of the sheet product feed mechanism at a varying rate of deceleration.

17. The dispenser of claim 16, wherein the control signal to the electric motor decreases the sheet product dispense speed of the sheet product feed mechanism at an increasing rate of deceleration and then a decreasing rate of deceleration.

18. The dispenser of claim 16, wherein the control signal to the electric motor gradually decreases the sheet product dispense speed of the sheet product feed mechanism over a period of time.

19. The dispenser of claim 16, wherein the varying rate of deceleration of the sheet product feed mechanism is based on a characteristic of the sheet product.

20. The dispenser of claim 19, wherein the varying rate of deceleration of the sheet product feed mechanism is based on a strength of the sheet product.

* * * * *